United States Patent [19]

Druckman

[11] Patent Number: 4,996,100

[45] Date of Patent: Feb. 26, 1991

[54] FABRIC OF MIXED YARNS

[76] Inventor: N. Ronald Druckman, 4 Woodbridge Cir., Evans, Ga. 30809

[21] Appl. No.: 310,302

[22] Filed: Feb. 13, 1989

[51] Int. Cl.[5] ..... B32B 7/00

[52] U.S. Cl. ..... 428/259; 428/225; 428/257; 428/258; 428/296

[58] Field of Search ..... 428/225, 245, 257, 259, 428/258, 296; 139/420 R, 420 A

[56] References Cited

U.S. PATENT DOCUMENTS

| | | | |
|---|---|---|---|
| 2,041,976 | 5/1936 | Standish | 139/420 R |
| 2,158,112 | 5/1939 | Finlayson et al. | 139/420 R |
| 2,266,631 | 12/1941 | Francis, Jr. | 139/420 A |
| 2,585,212 | 2/1952 | Backer | 139/420 R |
| 2,741,108 | 4/1956 | Rogosin | 139/420 R |
| 3,733,239 | 5/1973 | George | 428/257 |
| 3,918,134 | 11/1975 | Dean | 139/420 R |
| 4,149,571 | 4/1979 | Burroughs | 139/420 R |
| 4,289,173 | 9/1981 | Miller | 139/420 R |

*Primary Examiner*—James J. Bell
*Attorney, Agent, or Firm*—Bailey & Hardaway

[57] ABSTRACT

A fabric which has the durability characteristics of vinyl while possessing soft characteristics provided by a fabric having alternating vinyl and soft fabrics yarns in the warp direction and alternating vinyl and soft fabric yarns in the filling direction.

6 Claims, 1 Drawing Sheet

FABRIC OF MIXED YARNS

BRIEF DESCRIPTION OF THE INVENTION

This invention related generally to the art of fabrics and more particularly to an improved fabric suitable for use outside exposed to the environmental elements.

A variety of fabrics have been utilized for exterior uses such as lawn furniture, umbrellas, etc. Additionally cotton fabrics were utilized but it was found upon prolonged exposure the cotton fibers quickly broke down rendering the fabric useless for prolonged situations.

Cotton fabrics were replaced with various vinyl yarns or nonwoven films in order to have a prolonged life amongst the exterior environmental elements. A significant comfort and appearance price was paid in this transition in that the vinyl while possessing durability did not possess the aesthetic qualities of cotton or the soft feel thereof.

A particular significant break through occurred upon the discovery that vinyl yarns could be made in a particular way so as to be woven on a jacquard or dobby loom. Such fabrics have been made and sold under the trademark Jac-Qua-Tex. Acrylic yarns have additionally been woven and sold under the mark Jac-Qua-Tex and possess a degree of softness as well as durability which is superior to that of the vinyls. The vinyl yarns are considerably less expensive than the acrylic yarns rendering the vinyls more readily accepted for a variety of applications where cost is a significant factor.

Other soft yarns have also been utilized such as polypropylene and polyethylene but these have not always possessed the durability required when exposure to sunlight is prolonged.

Some mixed fabrics are described in the U.S. Pat. No. 3,918,134 to Dean. The fabrics described therein are for use in drapery fabrics.

Prior to the invention herein disclosed there was no satisfactory intermediate outdoor fabric between the extremes of vinyl and acrylic.

SUMMARY OF THE INVENTION

It is thus an object of this invention to provide a novel fabric suitable for outdoor use.

It is further and a more particular object of this invention to provide a fabric which has the durability characteristic of vinyl but while possessing soft characteristics as well.

These as well as other objects are accomplished by a fabric having alternating vinyl and soft fabrics yarns in the warp direction and alternating vinyl and soft fabric yarns in the filling direction.

DETAILED DESCRIPTION

In accordance with this invention it has been surprisingly found that a fabric may be formed of differing yarns having the characteristics of both yarns embodied in the fabric. It was unexpectedly found that only by a precise arrangement of yarns could this result be achieved. This result requires the certain vinyls with a soft yarn in both the warp and filling directions. The yarns in accordance with this invention are woven on a jacquard or dobby loom so as to provide not only the superior mixed characteristics of the two but a high level of design element which can only be achieved through the use of a jacquard or dobby loom.

Figure 1:
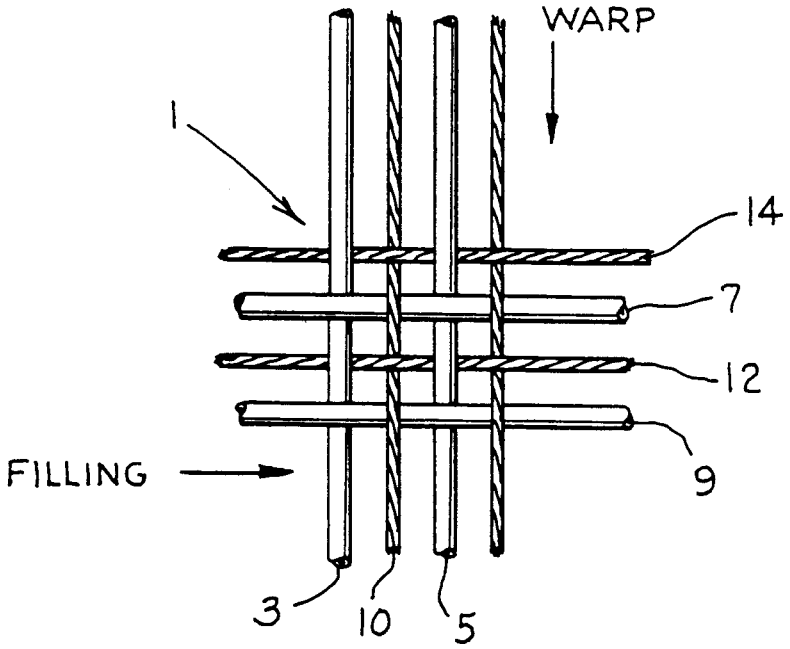
FIG. 1 of the drawings is an enlarged view of a fabric in accordance with this invention.

FIG. 1 of the drawings illustrates a close-up view of a fabric 1 in accordance with this invention. The warp direction is downward as indicated by the arrow and the filling direction is horizontal as illustrated. The essence of this invention is the incorporation of a vinyl yarn illustrated in the warp direction on the yarn 3 and 5 and in the filling direction on the yarns 7 and 9 with a soft yarn illustrated in the warp direction at 10 and in the filling direction at 12 and 14. While a basket weave pattern is illustrated, it is clear that a variety of weaves may be utilized with the only critical characteristics that the soft yarns and vinyl yarns alternate in both warp and filling directions.

Although the chemical nature of vinyl is well known to those skilled in the art, it may be important to point out that vinyl is a polymer of a vinyl compound (or product made from a vinyl compound) that is derived from ethylene by the removal of a hydrogen atom. Thus, as embodied within this invention vinyl refers to vinylidene chloride which is derived from ethylene by the removal of two hydrogen atoms from one carbon atom, and/or polyvinyl chloride, formed by heating vinyl chloride under pressure with azodiisobatyronitrile, which forms copolymers with vinylidene chloride (i.e. Saran). Thus, so as not to confuse these vinyls with other polymers and monomers which may contain a vinyl group, the specific vinyls of this invention will be referred to in the claims as "hard" yarns.

The soft fibers in accordance with this invention are preferably acrylic fibers but may be modacrylics as well as polypropylene, polyethylene and polyesters.

The fabric in accordance with this invention preferably has a pick range of 10 to 50 per inch in both the warp and filling direction. The vinyl yarn is sized from 220 denier to 1,000 denier while the soft yarn may have a size from 150 denier to 2,000 denier.

Upon weaving of the fabric on a jacquard or dobby loom the fabric is heat set in the way vinyl fabrics are normally heat set so as to bring about bonding of the vinyl yarns. The weave pattern of this invention has been found critical for this vinyl bonding to occur. Other arrangements did not result in this bonding.

Figure 2:
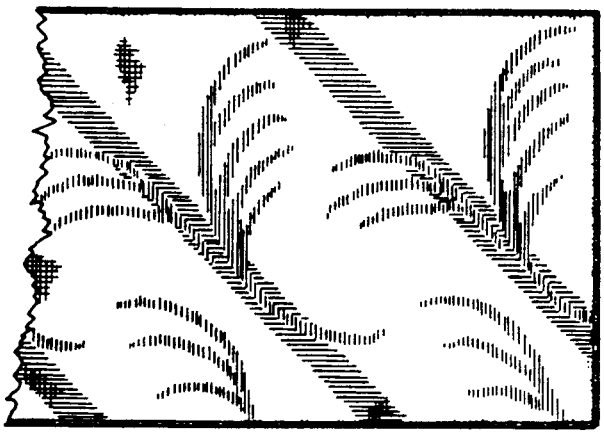
FIG. 2 of the drawings is a plan view of a fabric having design characteristics in accordance with this invention.

FIG. 2 of the drawings illustrates some of the complex designs which may be produced in accordance with this invention when utilizing the jacquard or dobby loom only under the very precise yarn characteristics set forth above can be utilized on a jacquard or dobby loom.

It is thus seen that the fabric of this invention provides a mixed fabric having the beneficial characteristics of vinyl as well as the soft feel characteristics of the soft yarn.

As many variations will become apparent to those of skill in the art from a reading of the above description which is exemplary in nature such variations and modifications are embodied within the spirit and scope of this invention as defined by the following appended claims.

That which is claimed is:

1. A woven fabric comprising alternating warp yarns of a hard and a soft yarn; and alternating filling yarns of a hard and a soft yarn;

said soft yarn being selected from the group consisting of acrylic fibers, polypropylene yarns, polyethylene and polyester.

2. The fabric according to claim 1 wherein said hard yarn comprises polyvinylchloride.

3. The fabric according to claim 1 wherein said hard yarn comprises a copolymer of ethylene and vinylidene chloride (saran).

4. The fabric according to claim 1 wherein said fabric has been heat set to bond said hard yarns to one another.

5. Fabric according to claim 1 wherein said soft yarn is a modacrylic yarn.

6. The fabric according to claim 1 wherein said fabric is woven of a jacquard or dobby loom.

* * * * *